US011154907B2

(12) United States Patent
Jikihara et al.

(10) Patent No.: US 11,154,907 B2
(45) Date of Patent: Oct. 26, 2021

(54) POWDER CLASSIFYING APPARATUS

(71) Applicants: NISSHIN SEIFUN GROUP INC., Tokyo (JP); NISSHIN ENGINEERING INC., Tokyo (JP)

(72) Inventors: Kenji Jikihara, Saitama (JP); Yusuke Igawa, Saitama (JP); Tatsuya Onishi, Fujimino (JP); Toru Yoshikawa, Saitama (JP); Kazumi Kozawa, Saitama (JP)

(73) Assignees: NISSHIN SEIFUN GROUP INC., Tokyo (JP); NISSHIN ENGINEERING INC., Tokyo (JP)

( * ) Notice: Subject to any disclaimer, the term of this patent is extended or adjusted under 35 U.S.C. 154(b) by 0 days.

(21) Appl. No.: 16/651,236

(22) PCT Filed: Sep. 14, 2018

(86) PCT No.: PCT/JP2018/034249
§ 371 (c)(1),
(2) Date: Mar. 26, 2020

(87) PCT Pub. No.: WO2019/065315
PCT Pub. Date: Apr. 4, 2019

(65) Prior Publication Data

US 2021/0078044 A1 Mar. 18, 2021

(30) Foreign Application Priority Data

Sep. 27, 2017 (JP) ..... JP2017-186918

(51) Int. Cl.
*B07B 7/08* (2006.01)
*B07B 7/086* (2006.01)
*B07B 7/083* (2006.01)

(52) U.S. Cl.
CPC ..... *B07B 7/086* (2013.01); *B07B 7/083* (2013.01)

(58) Field of Classification Search
CPC ..... B07B 7/086; B07B 7/083; B07B 7/08
See application file for complete search history.

(56) References Cited

U.S. PATENT DOCUMENTS 6,276,534 B1 * 8/2001 Huang ..... B07B 7/083 209/139.2
8,668,090 B2 * 3/2014 Taketomi ..... B07B 11/04 209/135

(Continued)

FOREIGN PATENT DOCUMENTS

JP 2000107698 A 4/2000
JP 2009034560 A 2/2009

(Continued)

*Primary Examiner* — Patrick H Mackey
(74) *Attorney, Agent, or Firm* — Muncy, Geissler, Olds & Lowe, P.C.

(57) ABSTRACT

This powder-classifying apparatus has: a centrifugation chamber configured so as to be sandwiched between two opposing members; an air supply unit that supplies air into the centrifugation chamber and generates a swirl flow; a raw material supply unit that supplies raw-material powder into the swirl flow; a fine powder recovery unit having an opening part through which air that includes fine powder classified within the centrifugation chamber is ejected to outside of the centrifugation chamber; a coarse powder recovery unit provided to the outer edge part of the centrifugation chamber, for ejecting classified coarse powder to outside of the centrifugation chamber; and an annular slit provided to at least one of the members that constitute the centrifugation chamber, the slit being provided in a region between the center part of the centrifugation chamber and the outer edge part.

15 Claims, 13 Drawing Sheets

(56) References Cited

U.S. PATENT DOCUMENTS

| | | | | |
|---|---|---|---|---|
| 9,050,630 | B2 * | 6/2015 | Kozawa | B07B 7/086 |
| 2009/0032443 | A1 | 2/2009 | Kenji | |
| 2010/0270214 | A1 | 10/2010 | Kenji | |
| 2016/0151806 | A1 * | 6/2016 | Kozawa | B07B 7/10 209/723 |
| 2018/0009004 | A1 * | 1/2018 | Jikihara | B07B 4/02 |

FOREIGN PATENT DOCUMENTS

| | | | | |
|---|---|---|---|---|
| JP | 4785802 | B2 | 10/2011 | |
| JP | 2014-057909 | A | 4/2014 | |
| WO | WO2015001905 | A1 | 1/2015 | |
| WO | WO-2016114234 | A1 * | 7/2016 | B07B 7/086 |
| WO | WO2016114234 | A1 | 7/2016 | |

* cited by examiner

POWDER CLASSIFYING APPARATUS

TECHNICAL FIELD

The present invention relates to a powder classifying apparatus that classifies raw material powder having a particle size distribution into fine powder and coarse powder according to a desired particle size (classification point) using a balance between a centrifugal force imparted to the powder through a whirling stream formed from gas and a drag, particularly to a powder classifying apparatus that achieves a smaller classification point while maintaining classification accuracy.

BACKGROUND ART

At present, nanoparticles such as oxide nanoparticles, nitride nanoparticles and carbide nanoparticles are used in the production of semiconductor substrates, printed circuit boards, electrical insulation materials for various electrical insulation parts and the like, cutting tools, dies, bearings and other high-hardness and high-precision machining tool materials, functional materials for humidity sensors and the like, and sintered bodies for use as precision sinter molding materials, and in the production of thermal sprayed parts such as engine valves made of materials that are required to be wear-resistant at a high temperature, as well as in the fields of electrode or electrolyte materials and various catalysts for fuel cells. The use of those nanoparticles improves bonding strength between different ceramics or different metals and denseness as well as functionalities of sintered bodies, thermal sprayed parts and the like.

The above-described nanoparticles are produced by a chemical approach in which various gases or the like are chemically reacted at high temperature or a physical approach in which substances are irradiated with an electron beam, laser beam or the like to be decomposed and vaporized, thereby generating nanoparticles. The nanoparticles produced by the above approaches have a particle size distribution and contain coarse powder and fine powder mixed together. The nanoparticles used in the applications described above preferably have a smaller proportion of coarse powder, since excellent properties can be achieved. Also for metallic fine particles, a smaller proportion of coarse powder is preferred because this leads to excellent properties.

Accordingly, powder classifying apparatuses are used to provide a whirling motion to powder by means of a whirling stream, thereby centrifuging powder into coarse powder and fine powder.

For instance, Patent Literature 1 describes a powder classifying apparatus in which powder having a particle size distribution is carried by an air stream and supplied. The powder classifying apparatus of Patent Literature 1 includes a hollow cavity in a disc-like shape (disc-like cavity portion) in which the supplied powder having a particle size distribution is classified, a powder supply port for supplying the powder having a particle size distribution to the disc-like cavity portion, a plurality of guide vanes arranged so as to each extend from an outer circumference of the disc-like cavity portion in an inward direction at a given angle, a discharge unit for an air stream including fine powder discharged from the disc-like cavity portion, a collection unit for coarse powder discharged from the disc-like cavity portion, and a plurality of air nozzles arranged on an outer circumferential wall of the disc-like cavity portion along a tangential direction of the outer circumferential wall below the guide vanes and blowing compressed air toward the collection unit for coarse powder inside the disc-like cavity portion to bring fine powder present near the collection unit for coarse powder back to the disc-like cavity portion.

Patent Literature 2 describes a classifying apparatus in which powder supplied from a supply port formed in the upper part of an apparatus body is guided downward while being swirled in the apparatus body, a suction pipe having a suction port at its upper end and constituted of a multilayer pipe is provided in the central part of the apparatus body, and powder having small particle sizes in the powder guided downward while being swirled is sucked from the suction port through the suction pipe.

In the Patent Literature 2, particles having different particle sizes are separately sucked and collected through the suction pipe constituted of a multilayer pipe.

CITATION LIST

Patent Literature

Patent Literature 1: JP 4785802 B
Patent Literature 2: JP 2000-107698 A

SUMMARY OF INVENTION

Technical Problems

While the powder classifying apparatus of Patent Literature 1 can classify raw material powder having a particle size distribution into fine powder and coarse powder at a desired particle size (classification point), the demanded particle size of fine powder becomes smaller recently, and it is desirable that the classification point of a powder classifying apparatus is further lowered.

In Patent Literature 2, one unit of raw material powder is classified in one classifying operation, and particles having different particle sizes are separately collected through the foregoing suction pipe constituted of a multilayer pipe, i.e., through respective pipes composing the multilayer pipe.

Thus, in Patent Literature 2, particles can be collected through the respective pipes composing the multilayer pipe, and this configuration reduces the variation in size of particles collected through each pipe; however, a classification point is determined by the air volume balance among the respective suction pipes, and this does not lead to a lower classification point.

An object of the present invention is to solve the problems inherent in the prior art and to provide a powder classifying apparatus that achieves a lower classification point while maintaining classification accuracy.

Solution to Problems

In order to attain the above object, the present invention provides a powder classifying apparatus classifying raw material powder having a particle size distribution into fine powder and coarse powder, the apparatus comprising: a centrifugal chamber of disc shape constituted of a space formed between two opposed members; a gas supply section configured to supply gas into the centrifugal chamber to generate a whirling stream; a raw material supply section configured to supply the raw material powder to the whirling stream generated in the centrifugal chamber; a fine powder collecting section that is disposed in a central portion of one of the two opposed members forming the centrifugal chamber, communicates with the centrifugal chamber, and has an opening portion used to discharge gas containing the fine powder separated through classification in the centrifugal chamber to an outside of the centrifugal chamber; a coarse powder collecting section that is disposed at an outer edge portion of the centrifugal chamber, communicates with the centrifugal chamber, and is configured to discharge the coarse powder separated through classification in the centrifugal chamber to the outside of the centrifugal chamber; an annular slit that is provided in at least one of the two opposed members forming the centrifugal chamber in a region between the central portion of the centrifugal chamber and the outer edge portion of the centrifugal chamber, communicates with the centrifugal chamber, and is configured to discharge gas in the centrifugal chamber to the outside of the centrifugal chamber; a first wall portion of cylindrical shape disposed at the opening portion of the centrifugal chamber to project in the centrifugal chamber, the opening portion being formed from a fine powder collecting pipe; and a second wall portion of cylindrical shape disposed at the other of the two opposed members forming the centrifugal chamber to face the first wall portion at a predetermined distance, wherein the annular slit has an inner diameter larger than an outer diameter of the opening portion.

Preferably, the annular slit is provided in, of the two opposed members forming the centrifugal chamber, a member having the opening portion, and the opening portion and the annular slit are concentrically arranged.

Preferably, the annular slit is provided in, of the two opposed members forming the centrifugal chamber, a member that does not have the opening portion.

Preferably, the annular slit is provided in each of the two opposed members forming the centrifugal chamber, and the annular slit provided in one of the two opposed members that has the opening portion is arranged concentrically with the opening portion.

Preferably, a suction port of the annular slit faces one of the two opposed members that has the annular slit, or a suction plane of the suction port of the annular slit is perpendicular to an opening plane of the opening portion.

Preferably, the annular slit has a bending flow path.

Preferably, the annular slit has a flow path larger in width than a suction port.

Preferably, a suction volume of the annular slit is smaller than a suction volume of the fine powder collecting section.

Advantageous Effects of Invention

According to the invention, since the annular slit is used to further collect coarse powder from fine powder to be collected by the fine powder collecting section before powder arrives at the fine powder collecting section, it is possible to achieve a lower classification point while maintaining classification accuracy, thus obtaining fine powder with a smaller particle size.

DESCRIPTION OF EMBODIMENTS

On the following pages, a powder classifying apparatus of the present invention is described in detail with reference to a preferred embodiment shown in the accompanying drawings.

Figure 1:
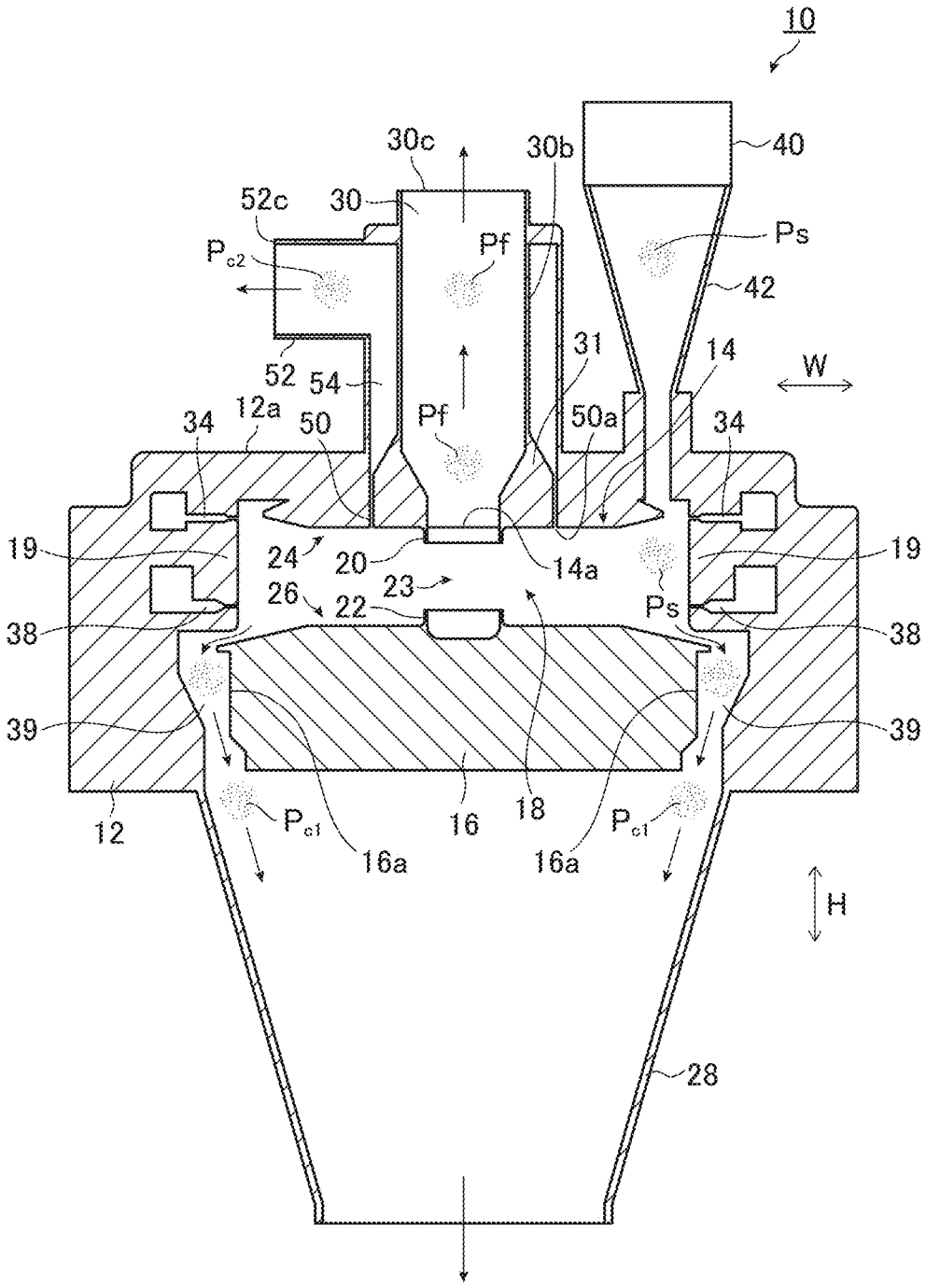
FIG. 1 is a schematic cross-sectional view showing a first example of a powder classifying apparatus in an embodiment of the invention.
Figure 2:
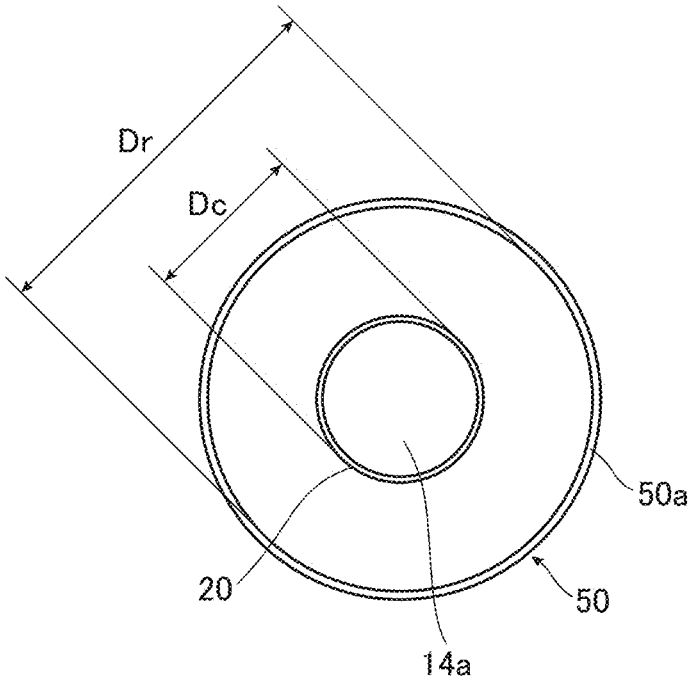
FIG. 2 is a schematic view showing a position of a slit of the first example of the powder classifying apparatus in the embodiment of the invention.

FIG. 1 is a schematic cross-sectional view showing a first example of a powder classifying apparatus in an embodiment of the invention, and FIG. 2 is a schematic view showing a position of a slit of the first example of the powder classifying apparatus in the embodiment of the invention.

A powder classifying apparatus 10 shown in FIG. 1 classifies raw material powder having a particle size distribution into fine powder and coarse powder according to a desired particle size (classification point) using a balance between a centrifugal force imparted to the powder through a whirling stream formed from gas and a drag. For example, the powder classifying apparatus 10 shown in FIG. 1 is configured to remove coarse powder $P_{c2}$ in one direction through an annular slit 50 to be described later.

The powder classifying apparatus 10 shown in FIG. 1 includes a cylindrical casing 12, for instance. The casing 12 is provided therein with an upper disc-shaped portion 14 in a circular shape. A lower disc-shaped portion 16 having a substantially circular outline is disposed to face the upper disc-shaped portion 14 at a predetermined distance. The upper disc-shaped portion 14 and the lower disc-shaped portion 16 face each other in a direction H.

A substantially disc-shaped centrifugal chamber 18 is defined between the upper disc-shaped portion 14 and the lower disc-shaped portion 16, and the outer periphery of the centrifugal chamber 18 in the circumferential direction is closed by an annular portion 19 of the casing 12. Thus, the centrifugal chamber 18 is a space formed between the upper disc-shaped portion 14 and the lower disc-shaped portion 16 facing each other. The upper disc-shaped portion 14 and the lower disc-shaped portion 16 are members forming the space of the centrifugal chamber 18.

The upper disc-shaped portion 14 is provided in its central portion with an opening portion 14*a*, and the opening portion 14*a* communicates with the centrifugal chamber 18. The opening portion 14*a* has, for instance, a circular shape.

The upper disc-shaped portion 14 is provided with a first wall portion 20 projecting in the centrifugal chamber 18 along the edge of the opening portion 14*a*. The first wall portion 20 is constituted of, for example, a cylindrical member having the same inner diameter as the opening portion 14*a*. The first wall portion 20 communicates with the opening portion 14*a*. A second wall portion 22 of cylindrical shape is disposed on the lower disc-shaped portion 16, which is the other member, to face the first wall portion 20 at a predetermined distance such that a gap 23 is formed therebetween. The first wall portion 20 and the second wall portion 22 are situated in the central portion of the centrifugal chamber 18 in a direction W. The direction W is perpendicular to the direction H.

A surface portion 24 of the upper disc-shaped portion 14 that faces the centrifugal chamber 18 is constituted of, for instance, a flat surface parallel to the direction W.

A surface portion 26 of the lower disc-shaped portion 16 that faces the centrifugal chamber 18 is constituted of, for instance, a flat surface parallel to the direction W.

A fine powder collecting pipe 30 is disposed at the opening portion 14*a* to project in a direction perpendicular to a surface 12*a* of the casing 12. This perpendicular direction is parallel to the direction H.

The fine powder collecting pipe 30 is used to discharge gas containing fine powder Pf separated through classification in the centrifugal chamber 18, to the outside of the centrifugal chamber 18 via the gap 23. An end 30*c* of the fine powder collecting pipe 30 on the opposite side from the centrifugal chamber 18 is joined to a suction blower (not shown) via, for example, a bag filter (not shown) and other components. The bug filter (not shown), the suction blower (not shown) and other components constitute a fine powder collecting device. The fine powder collecting pipe 30 constitutes a fine powder collecting section.

A gap 39 is formed between an outer end portion 16*a* of the lower disc-shaped portion 16 and the casing 12. The gap 39 is situated at the outer edge portion of the centrifugal chamber 18. For instance, a coarse powder collecting chamber 28 of hollow truncated cone shape is disposed under the casing 12. The centrifugal chamber 18 and the coarse powder collecting chamber 28 communicate with each other via the gap 39. The outer edge portion of the centrifugal chamber 18 is larger in height in the direction H than the central portion thereof, and the outer edge portion of the centrifugal chamber 18 extends wider in the direction H.

The coarse powder collecting chamber 28 is used to discharge coarse powder $P_{c1}$ separated through classification in the centrifugal chamber 18, to the outside of the centrifugal chamber 18. The coarse powder collecting chamber 28 is provided with a coarse powder collecting pipe (not shown) for collecting separated coarse powder. The coarse powder collecting pipe is provided at its lower end with a hopper (not shown) via a rotary valve (not shown). The coarse powder $P_{c1}$ separated in the centrifugal chamber 18 is collected in the hopper via the gap 39, the coarse powder collecting chamber 28 and the coarse powder collecting pipe. The coarse powder collecting chamber 28 constitutes a coarse powder collecting section.

A plurality of first air nozzles 34 are disposed in the annular portion 19 of the casing 12 on the fine powder collecting pipe 30 side in the H direction. Second air nozzles 38 are also disposed in the annular portion 19 under the first air nozzles 34 in the H direction.

The plurality of first air nozzles 34 are disposed along the outer edge of the centrifugal chamber 18 and arranged at regular intervals in the circumferential direction of the centrifugal chamber 18 at a predetermined angle to a tangential direction of the outer edge of the centrifugal chamber 18. The number of the first air nozzles 34 is for example six.

Although not illustrated in detail, as with the first air nozzles 34, the plurality of second air nozzles 38 are disposed along the outer edge of the centrifugal chamber 18 and arranged at regular intervals in the circumferential direction of the centrifugal chamber 18 at a predetermined angle to a tangential direction of the outer edge of the centrifugal chamber 18. The number of the second air nozzles 38 is for example six. The first air nozzles 34 and the second air nozzles 38 constitute a gas supply section.

The first air nozzles 34 and the second air nozzles 38 are separately connected to compressed gas supply sections (not shown). Upon supply of gas under predetermined pressures from the compressed gas supply sections to the first air nozzles 34 and the second air nozzles 38, compressed gas is blown out from the first air nozzles 34 and the second air nozzles 38 separately, whereby whirling streams whirling in the same direction are formed in the centrifugal chamber 18. The type of gas is appropriately determined depending on the raw material powder to be classified, the purpose or other factors, and one example of gas is air. When raw material powder is reactive with air, another type of gas that is not reactive therewith is suitably used.

The numbers of the first air nozzles 34 and the second air nozzles 38 disposed are not limited to the above-mentioned numbers, may be one or plural, and are appropriately determined depending on the apparatus configuration or other factors.

The second air nozzles 38 are not limited to nozzles, may be guide vanes or other components, and appropriately determined depending on the apparatus configuration.

The casing 12 is provided on its surface 12*a* with a supply pipe 42 that is situated at a predetermined distance from the fine powder collecting pipe 30 in the direction W. The supply pipe 42 is disposed at the outer edge portion of the casing 12. For instance, the supply pipe 42 is provided at its top with a raw material supply section 40 for supplying raw material powder Ps into the centrifugal chamber 18. The supply pipe 42 is configured such that, for example, its upper portion has a hollow truncated cone shape and its joint portion connected to the casing 12 has a constant diameter.

An annular slit 50 communicating with the centrifugal chamber 18 is provided in the upper disc-shaped portion 14 between the central portion of the centrifugal chamber 18 and the outer edge portion of the centrifugal chamber 18. The annular slit 50 is used to discharge gas in the centrifugal chamber 18 to the outside of the centrifugal chamber 18 and is provided on the outer side of the opening portion 14*a*.

For instance, a pipe 52 is disposed to surround the outer periphery 30*b* of the fine powder collecting pipe 30 with a gap. A defining member 31 is disposed between the fine powder collecting pipe 30 and the pipe 52, and thus, the annular slit 50 having a predetermined width is formed. The annular slit 50 has the predetermined width due to the presence of the defining member 31 disposed at the outer periphery 30*b* of the fine powder collecting pipe 30 but has a wider gap in a region where the defining member 31 is absent. In other words, the annular slit 50 has a larger width in the region where the defining member 31 is absent; thus, the annular slit 50 has a flow path 54 larger in width than a suction port 50*a*.

A part of the pipe 52 is bent at about 90 degrees. An end portion 52*c* of the bending part of the pipe 52 is joined to a suction blower (not shown) via, for example, a bag filter (not shown) and other components. The bag filter (not shown), the suction blower (not shown) and other components constitute a coarse powder collecting device.

As shown in FIG. 2, the annular slit 50 has an inner diameter Dr larger than the outer diameter Dc of the first wall portion 20 of the opening portion 14*a*. The opening portion 14*a* and the annular slit 50 are concentrically arranged.

The suction blower sucks substances in the pipe 52, whereby gas containing, of the raw material powder Ps fed into the centrifugal chamber 18, powder (hereinafter also called "coarse powder $P_{c2}$") larger than the fine powder Pf and smaller than the coarse powder $P_{c1}$ in size is discharged to the outside of the centrifugal chamber 18 through the suction port 50*a* of the annular slit 50. Thus, the coarse powder $P_{c2}$ is removed. The relationship between the fine powder Pf, the coarse powder $P_{c1}$ and the coarse powder $P_{c2}$ is $Pf<P_{c2}<P_{c1}$.

Owing to the annular slit 50, the powder classifying apparatus 10 shown in FIG. 1 can remove, in addition to the coarse powder $P_{c1}$, the coarse powder $P_{c2}$ having a larger particle size than the fine powder Pf from the raw material powder Ps. As a result, the fine powder Pf can have a smaller particle size at the end. Thus, it is possible to achieve a lower classification point while maintaining classification accuracy.

The suction volume of the annular slit 50 is preferably smaller than the suction volume of the fine powder collecting pipe 30 (fine powder collecting section).

This is because when the suction volume of the annular slit 50 is increased, the amount of gas used for a whirling stream formed in the centrifugal chamber 18 decreases accordingly, so that the whirling stream becomes weaker, and the particle size of the fine powder Pf determined by the strength of the whirling stream is rather increased.

Next, a second example of the powder classifying apparatus is described.

Figure 3:
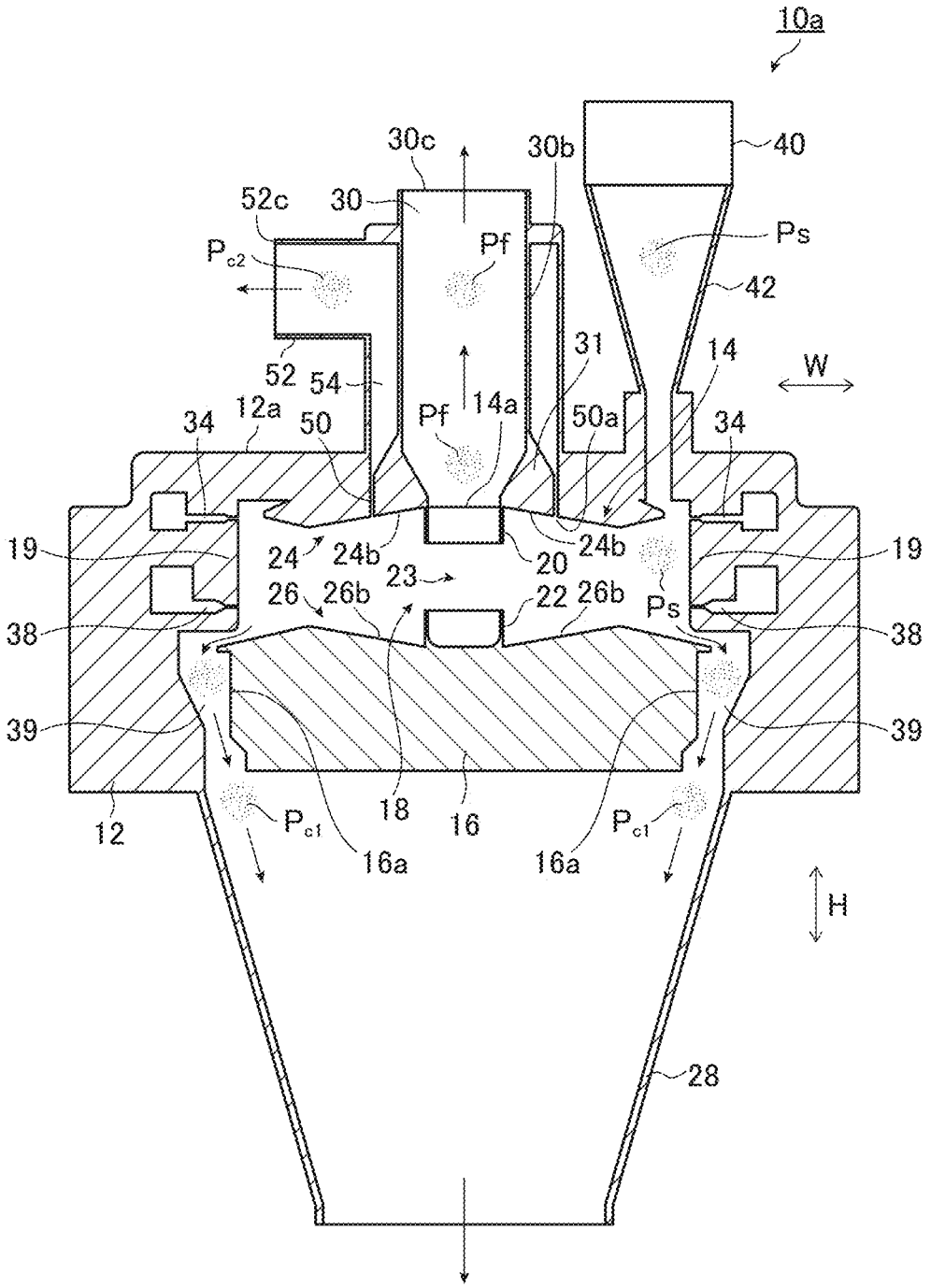
FIG. 3 is a schematic cross-sectional view showing a second example of the powder classifying apparatus in the embodiment of the invention.

FIG. 3 is a schematic cross-sectional view showing the second example of the powder classifying apparatus in the embodiment of the invention.

For a powder classifying apparatus 10*a* shown in FIG. 3, constituent elements identical to those of the powder classifying apparatus 10 shown in FIG. 1 are assigned the same reference signs and will not be described in detail.

The powder classifying apparatus 10*a* shown in FIG. 3 is different from the powder classifying apparatus 10 shown in FIG. 1 in that the surface portion 24 of the upper disc-shaped portion 14 and the surface portion 26 of the lower disc-shaped portion 16 are configured differently, and otherwise has the same configuration as the powder classifying apparatus 10 shown in FIG. 1. The powder classifying apparatus 10*a* shown in FIG. 3 can provide the same effects as those obtained with the powder classifying apparatus 10 shown in FIG. 1.

In the powder classifying apparatus 10*a* shown in FIG. 3, the surface portion 24 of the upper disc-shaped portion 14 that faces the centrifugal chamber 18 is provided with an inclined portion 24*b* on the side closer to the cylindrical first wall portion 20. The surface portion 26 of the lower disc-shaped portion 16 that faces the centrifugal chamber 18 is provided with an inclined portion 26*b* on the side closer to the cylindrical second wall portion 22. The inclined portion 24*b* and the inclined portion 26*b* are inclined surfaces constituted of flat surfaces, have linear cross sections, and are inclined such that the centrifugal chamber 18 can have an increased height.

The angle of the inclined portion 24*b* of the upper disc-shaped portion 14 and the angle of the inclined portion 26*b* of the lower disc-shaped portion 16 with respect to a line parallel to the direction W are each represented by θ. The angle θ is preferably 5° to 30° and more preferably 10° to 20°. With an angle θ of about 5° to about 30°, the classification point can be lowered in the classification of the raw material powder Ps into the fine powder Pf, the coarse powder $P_{c1}$ and the coarse powder $P_{c2}$.

The angle θ of the inclined portion 24*b* of the upper disc-shaped portion 14 and the angle θ of the inclined portion 26*b* of the lower disc-shaped portion 16 may be the same or different.

Next, a third example of the powder classifying apparatus is described.

Figure 4:
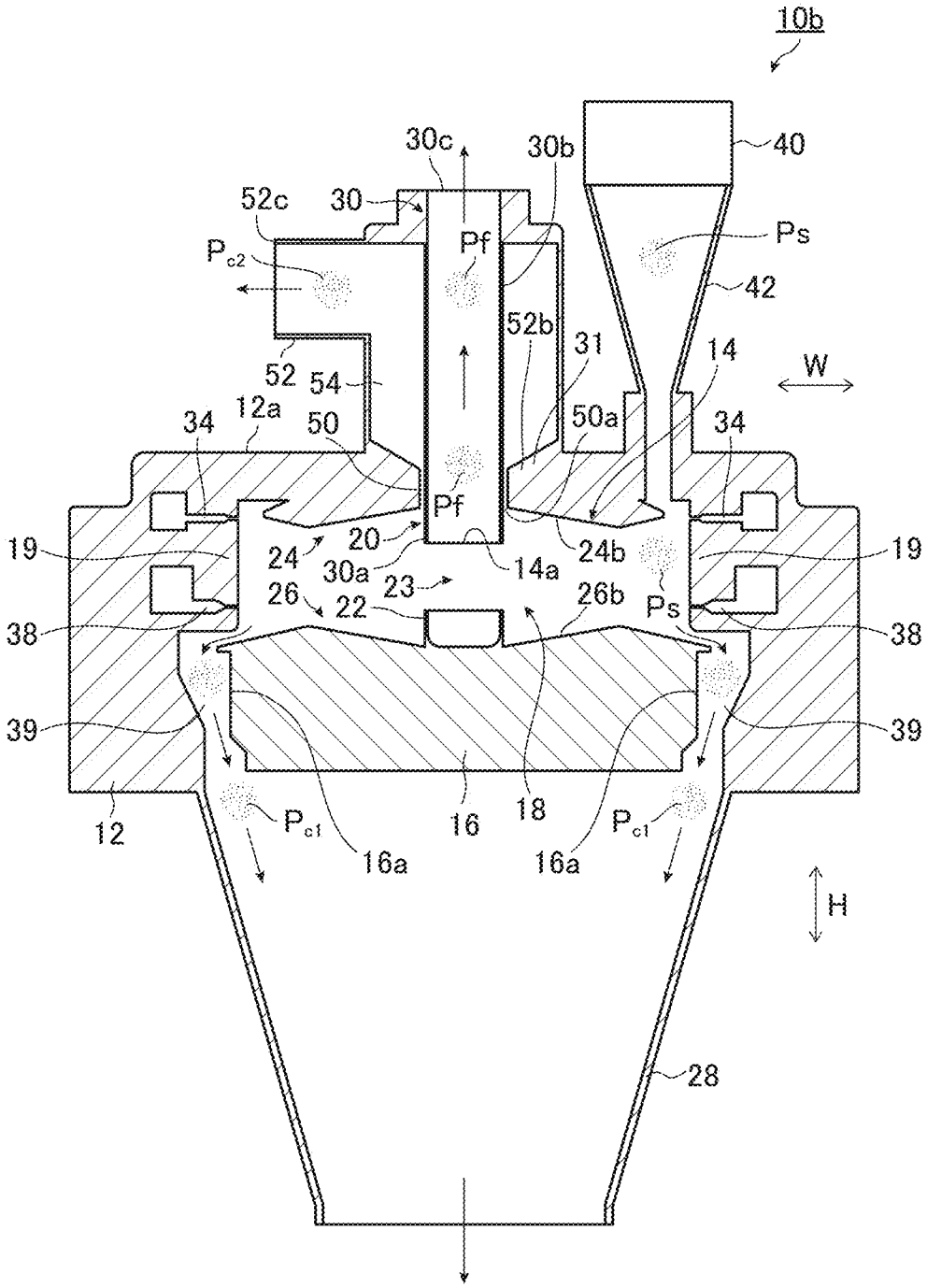
FIG. 4 is a schematic cross-sectional view showing a third example of the powder classifying apparatus in the embodiment of the invention.

FIG. 4 is a schematic cross-sectional view showing the third example of the powder classifying apparatus in the embodiment of the invention.

For a powder classifying apparatus 10*b* shown in FIG. 4, constituent elements identical to those of the powder classifying apparatus 10*a* shown in FIG. 3 are assigned the same reference signs and will not be described in detail.

The powder classifying apparatus 10*b* shown in FIG. 4 is different from the powder classifying apparatus 10*a* shown in FIG. 3 in the configurations of the annular slit 50 and the fine powder collecting pipe 30, and otherwise has the same configuration as the powder classifying apparatus 10*a* shown in FIG. 3.

In the powder classifying apparatus 10*b* shown in FIG. 4, the fine powder collecting pipe 30 is constituted of a straight pipe. The fine powder collecting pipe 30 is disposed such that its end portion 30*a* projects in the centrifugal chamber 18. In the powder classifying apparatus 10*b*, the end portion 30*a* of the fine powder collecting pipe 30 constitutes the first wall portion 20, and an opening of the end portion 30*a* of the fine powder collecting pipe 30, i.e., an opening of the first wall portion 20 forms the opening portion 14*a*.

The pipe 52 is disposed to surround the outer periphery 30*b* of the fine powder collecting pipe 30 with a gap. The pipe 52 has an overhang portion 52*b* overhanging in the gap on the suction port 50*a* side. The outer periphery 30*b* of the fine powder collecting pipe 30 and the overhang portion 52*b* form the annular slit 50, and the annular slit 50 has a predetermined width. The powder classifying apparatus 10*b* shown in FIG. 4 can provide the same effects as those obtained with the powder classifying apparatus 10*a* shown in FIG. 3 even with the annular slit 50 being situated at the outer periphery 30*b* of the fine powder collecting pipe 30.

Next, a fourth example of the powder classifying apparatus is described.

Figure 5:
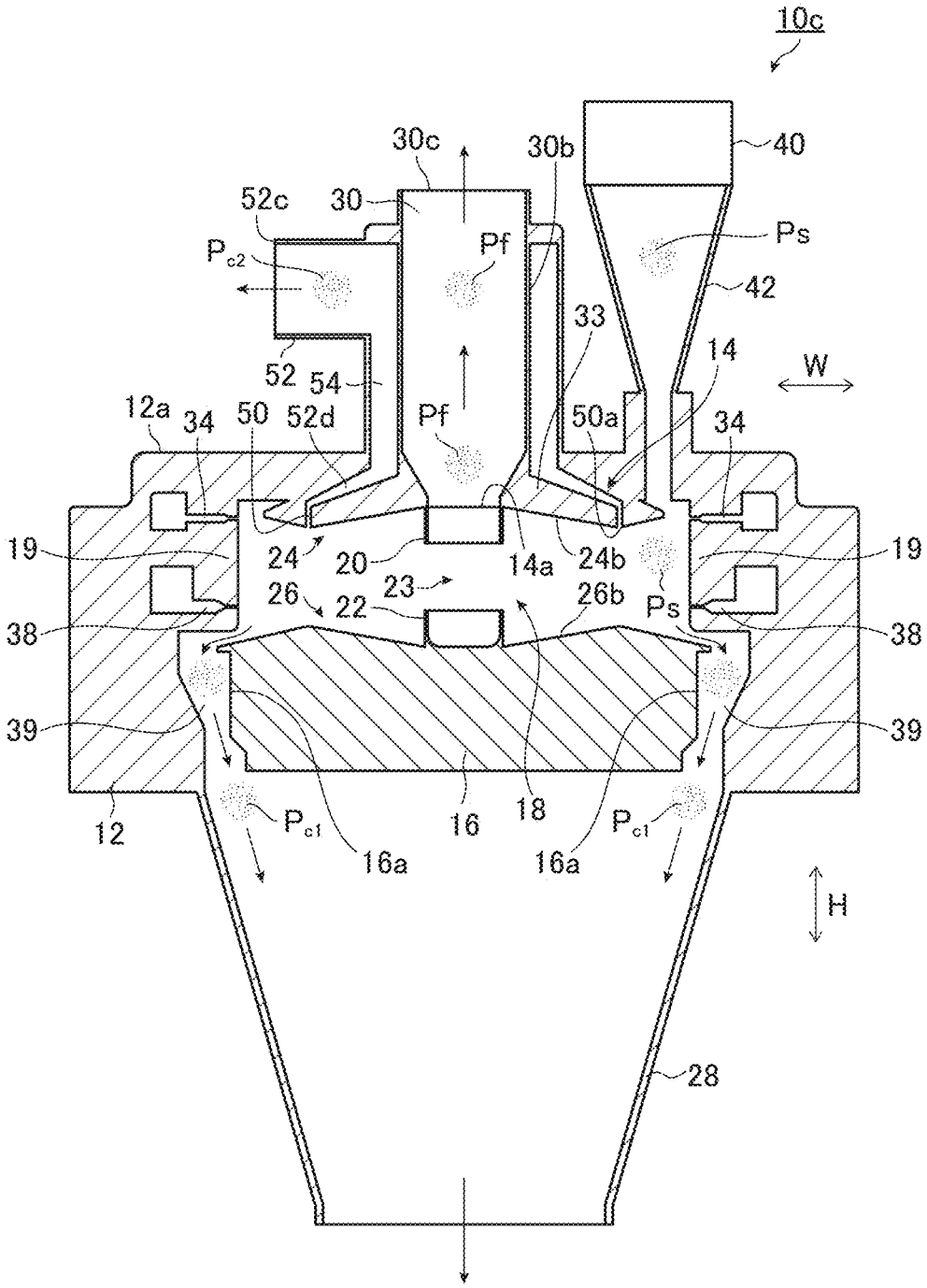
FIG. 5 is a schematic cross-sectional view showing a fourth example of the powder classifying apparatus in the embodiment of the invention.

FIG. 5 is a schematic cross-sectional view showing the fourth example of the powder classifying apparatus in the embodiment of the invention.

For a powder classifying apparatus 10*c* shown in FIG. 5, constituent elements identical to those of the powder classifying apparatus 10*a* shown in FIG. 3 are assigned the same reference signs and will not be described in detail.

The powder classifying apparatus 10*c* shown in FIG. 5 is different from the powder classifying apparatus 10*a* shown in FIG. 3 in the configuration of the annular slit 50, and otherwise has the same configuration as the powder classifying apparatus 10*a* shown in FIG. 3.

In the powder classifying apparatus 10*c* shown in FIG. 5, the annular slit 50 has a larger inner diameter and is provided on the side closer to the outer edge portion of the centrifugal chamber 18. The pipe 52 increases in diameter at its end on the slit 50 side and thus has an increased diameter portion 52*d*. A defining member 33 provided at the outer periphery of the fine powder collecting pipe 30 is disposed in the increased diameter portion 52*d*. The flow path of the annular slit 50 bends due to the presence of the increased diameter portion 52*d* and the defining member 33. The end surface of the defining member 33 on the centrifugal chamber 18 side is inclined, and thus, the defining member 33 provides the inclined portion 24*b*.

The powder classifying apparatus 10*c* shown in FIG. 5 can collect the coarse powder $P_{c2}$ as described above and provide the same effects as those obtained with the powder classifying apparatus 10*a* shown in FIG. 3 even with the annular slit 50 being disposed on the side closer to the outer edge portion of the centrifugal chamber 18 and having the bending flow path.

Next, a fifth example of the powder classifying apparatus is described.

Figure 6:
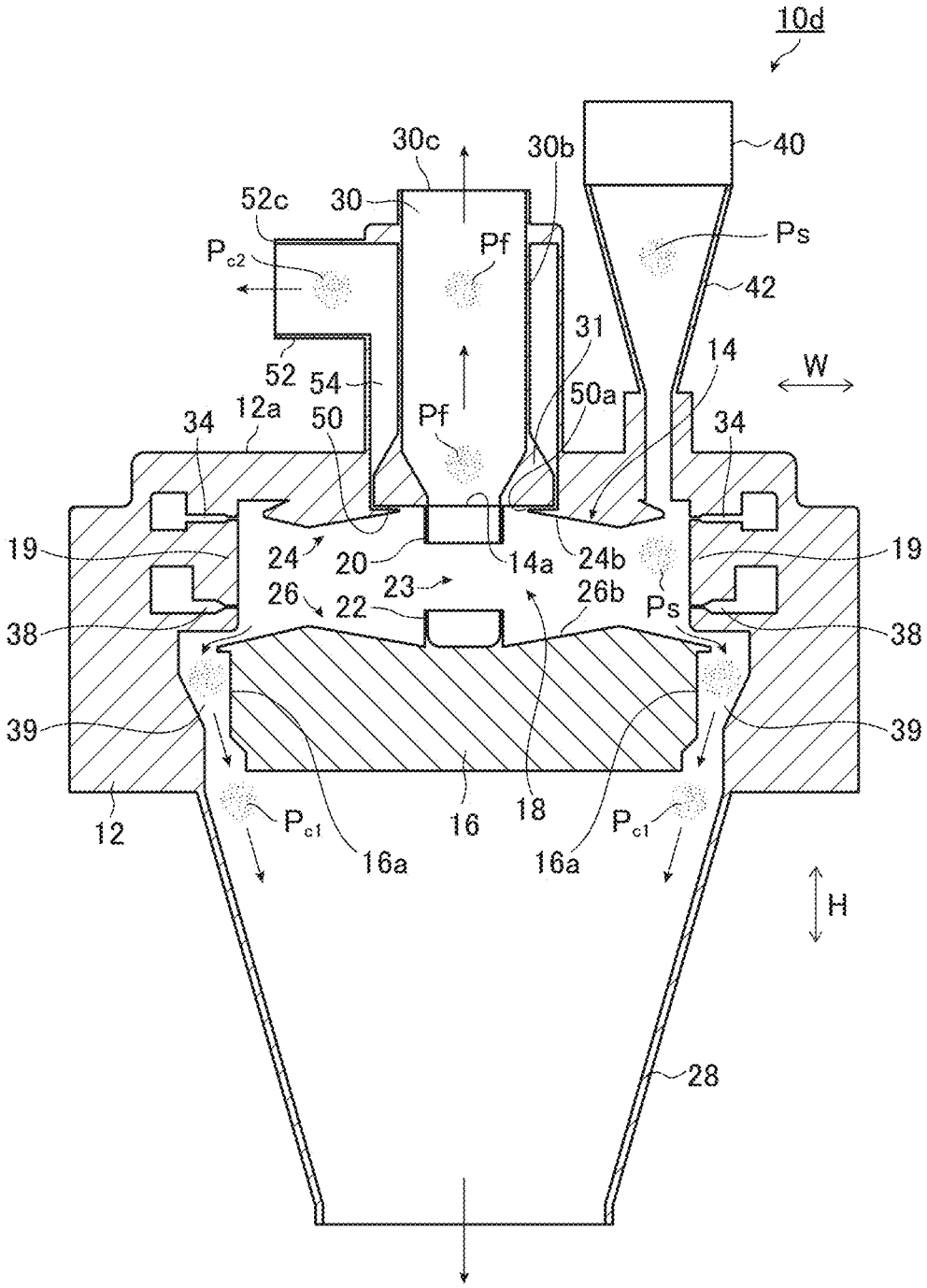
FIG. 6 is a schematic cross-sectional view showing a fifth example of the powder classifying apparatus in the embodiment of the invention.
Figure 7:
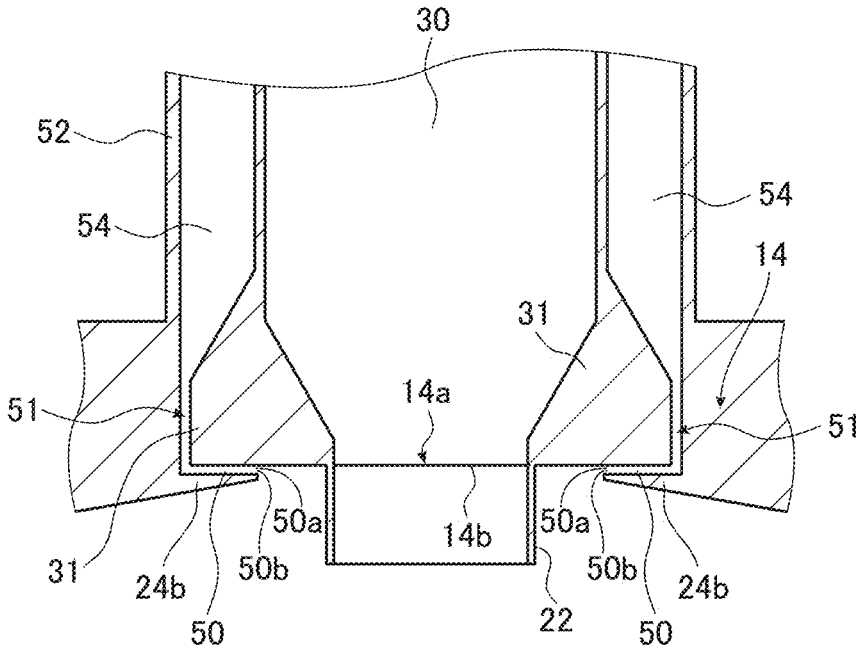
FIG. 7 is a schematic cross-sectional view showing a position of a slit of the fifth example of the powder classifying apparatus in the embodiment of the invention.

FIG. 6 is a schematic cross-sectional view showing the fifth example of the powder classifying apparatus in the embodiment of the invention, and FIG. 7 is a schematic cross-sectional view showing a position of a slit of the fifth example of the powder classifying apparatus in the embodiment of the invention.

For a powder classifying apparatus 10*d* shown in FIGS. 6 and 7, constituent elements identical to those of the powder classifying apparatus 10*a* shown in FIG. 3 are assigned the same reference signs and will not be described in detail.

The powder classifying apparatus 10*d* shown in FIG. 6 is different from the powder classifying apparatus 10*a* shown in FIG. 3 in the configuration of the annular slit 50, and otherwise has the same configuration as the powder classifying apparatus 10*a* shown in FIG. 3.

The annular slit 50 of the powder classifying apparatus 10*d* shown in FIG. 6 is configured such that the orientation of a suction plane 50*b* of the suction port 50*a* is different, that is, the suction plane 50*b* is not parallel with an opening plane 14*b* of the opening portion 14*a* but perpendicular to the opening plane 14*b* of the opening portion 14*a*, as shown in FIG. 7. The annular slit 50 has a bending flow path 51 having the same width as the suction port 50*a*. This flow path 51 communicates with a flow path 54 having a width larger than that of the suction port 50*a*. The inclined portion 24*b* extends toward the defining member 31 and thereby forms a part of the annular slit 50.

The powder classifying apparatus 10*d* shown in FIG. 6 can collect the coarse powder $P_{c2}$ as described above and provide the same effects as those obtained with the powder classifying apparatus 10*a* shown in FIG. 3 even with the suction plane 50*b* of the suction port 50*a* and the opening plane 14*b* of the opening portion 14*a* being perpendicular to each other and the annular slit 50 having the bending flow path 51 as shown in FIG. 7.

Next, a sixth example of the powder classifying apparatus is described.

Figure 8:
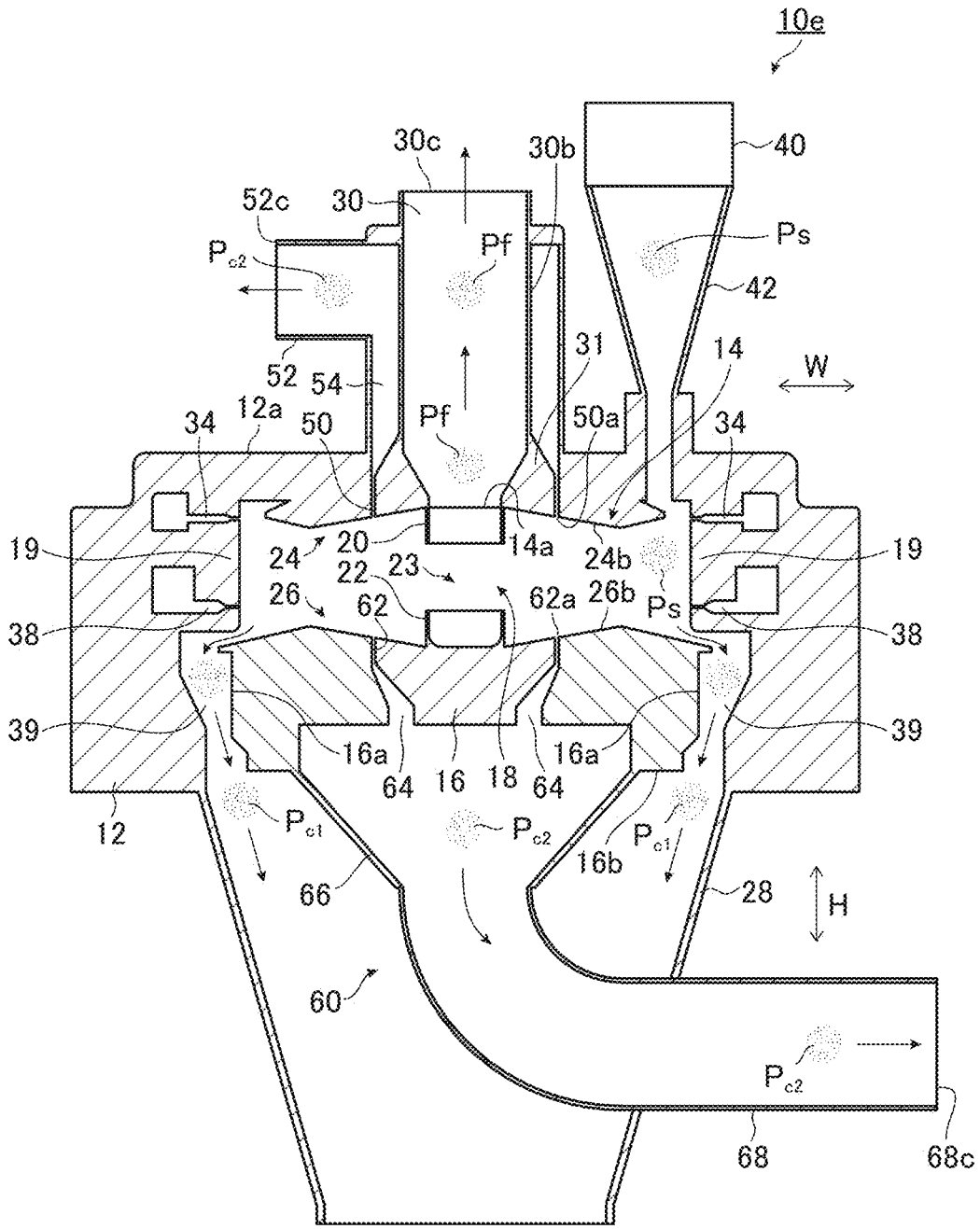
FIG. 8 is a schematic cross-sectional view showing a sixth example of the powder classifying apparatus in the embodiment of the invention.

FIG. 8 is a schematic cross-sectional view showing the sixth example of the powder classifying apparatus in the embodiment of the invention.

For a powder classifying apparatus 10*e* shown in FIG. 8, constituent elements identical to those of the powder classifying apparatus 10*a* shown in FIG. 3 are assigned the same reference signs and will not be described in detail.

The powder classifying apparatus 10*e* shown in FIG. 8 is different from the powder classifying apparatus 10*a* shown in FIG. 3 in that two annular slits 50 and 62 are provided, and otherwise has the same configuration as the powder classifying apparatus 10*a* shown in FIG. 3.

In the powder classifying apparatus 10*e* shown in FIG. 8, the annular slit 50 and the annular slit 62 are provided to face each other. The annular slit 62 is provided in the lower disc-shaped portion 16.

The annular slit 62 is disposed with its suction port 62*a* facing the inclined portion 26*b*, and has a flow path 64 communicating with the suction port 62*a* and wider than the suction port 62*a*.

The annular slit 62 has an inner diameter (not shown) larger than the outer diameter Dc of the first wall portion 20 of the opening portion 14*a* (see FIG. 2) as with the annular slit 50. When the casing 12 is viewed in the direction H from the surface 12*a* side, the opening portion 14*a* and the annular slit 62 are concentrically arranged. That is, the opening portion 14*a*, the annular slit 50 and the annular slit 62 are concentrically arranged.

A collecting chamber 66 of hollow truncated cone shape that communicates with the flow path 64 is disposed at the bottom surface 16*b* of the lower disc-shaped portion 16. The collecting chamber 66 is provided with a discharge pipe 68. An end portion 68*c* of the discharge pipe 68 is joined to a suction blower (not shown) via, for example, a bag filter (not shown) and other components. The bag filter (not shown), the suction blower (not shown) and other components constitute a coarse powder collecting device.

The suction blower sucks substances in the discharge pipe 68, whereby the coarse powder $P_{c2}$ of the raw material powder Ps fed into the centrifugal chamber 18 is discharged to the outside of the centrifugal chamber 18 through the suction port 62*a* of the annular slit 62. Thus, the coarse powder $P_{c2}$ is removed.

The powder classifying apparatus 10*e* shown in FIG. 8 is provided with the annular slit 50 and the annular slit 62 and therefore can remove the coarse powder $P_{c2}$ in two directions, i.e., from the upper and lower sides of the centrifugal chamber 18, thus achieving the same effects as those obtained with the powder classifying apparatus 10*a* shown in FIG. 3.

Figure 9:
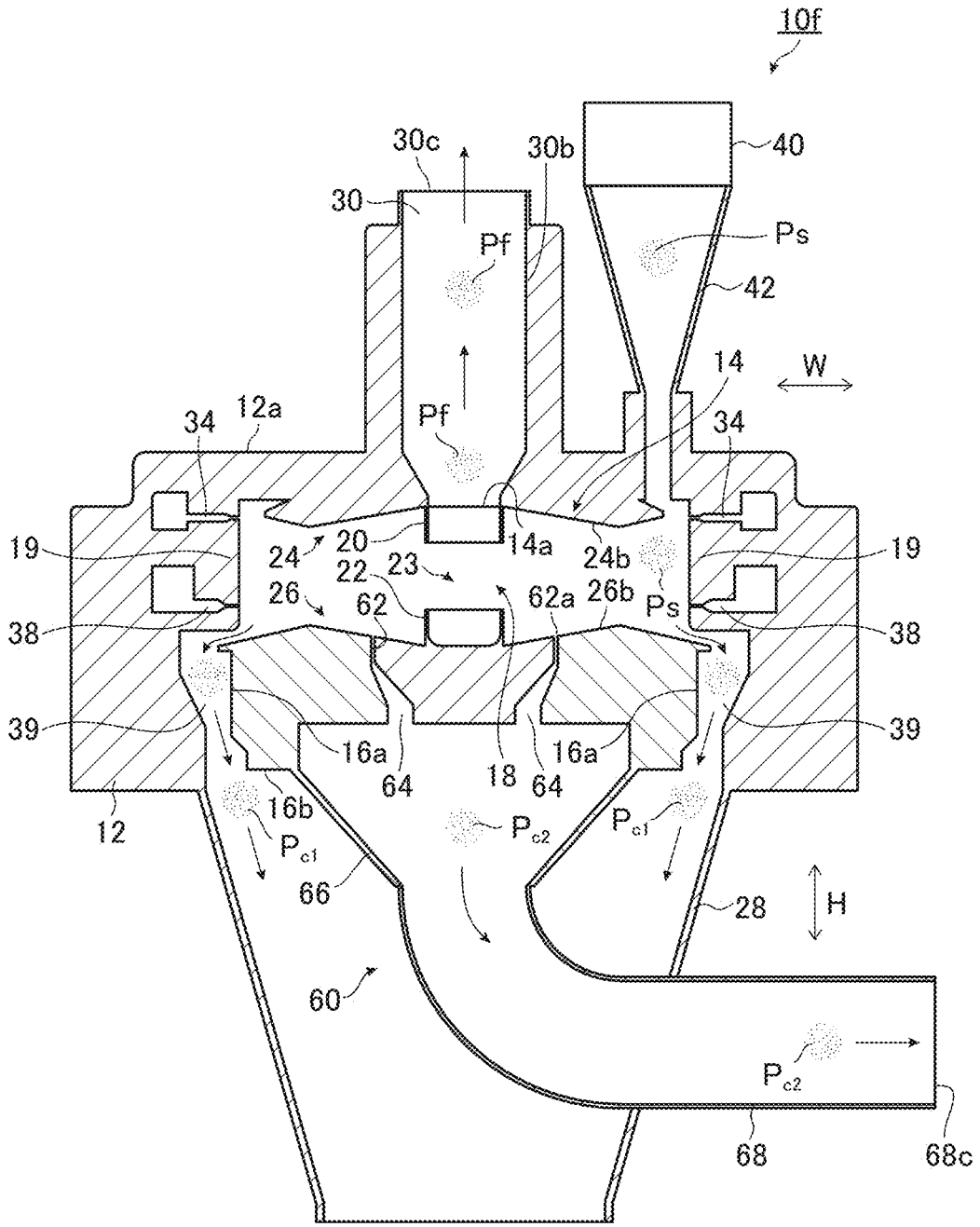
FIG. 9 is a schematic cross-sectional view showing a seventh example of the powder classifying apparatus in the embodiment of the invention.

The powder classifying apparatus 10*e* shown in FIG. 8 is configured to have the annular slit 50 and the annular slit 62 and remove the coarse powder $P_{c2}$ from the upper and lower sides of the centrifugal chamber 18; however, the invention is not limited thereto, and as can be seen from a seventh example of a powder classifying apparatus 10*f* shown in FIG. 9, only the lower disc-shaped portion 16 may be provided with the annular slit 62 without providing the annular slit 50 to the upper disc-shaped portion 14 such that the coarse powder $P_{c2}$ is removed in one direction. In this case, when the casing 12 is viewed in the direction H from the surface 12*a* side, for example, the opening portion 14*a* and the annular slit 62 are concentrically arranged.

In the powder classifying apparatus 10*f*, the suction blower sucks substances in the discharge pipe 68, whereby the coarse powder $P_{c2}$ of the raw material powder Ps fed into the centrifugal chamber 18 is discharged to the outside of the centrifugal chamber 18 through the annular slit 62. Thus, the coarse powder $P_{c2}$ is removed. In this manner, the configuration in which the annular slit 62 is provided in a member that does not have the opening 14*a* may be employed, and even with this, the same effects as those obtained with the powder classifying apparatus 10*a* shown in FIG. 3 can still be achieved.

The annular slit may be provided in at least one of the two opposed members forming the centrifugal chamber 18, i.e., the upper disc-shaped portion 14 and the lower disc-shaped portion 16, and only the lower disc-shaped portion 16 may be provided with the annular slit 62 as in the powder classifying apparatus 10*f* shown in FIG. 9.

The annular slit is preferably arranged concentrically with the opening portion. In the case where the annular slit is formed in a member having no opening portion (lower disc-shaped portion 16), when the casing 12 is viewed in the direction H from the surface 12*a* side, for example, the opening portion 14*a* and the annular slit 62 are preferably concentrically arranged.

Next, an eighth example of the powder classifying apparatus is described.

Figure 10:
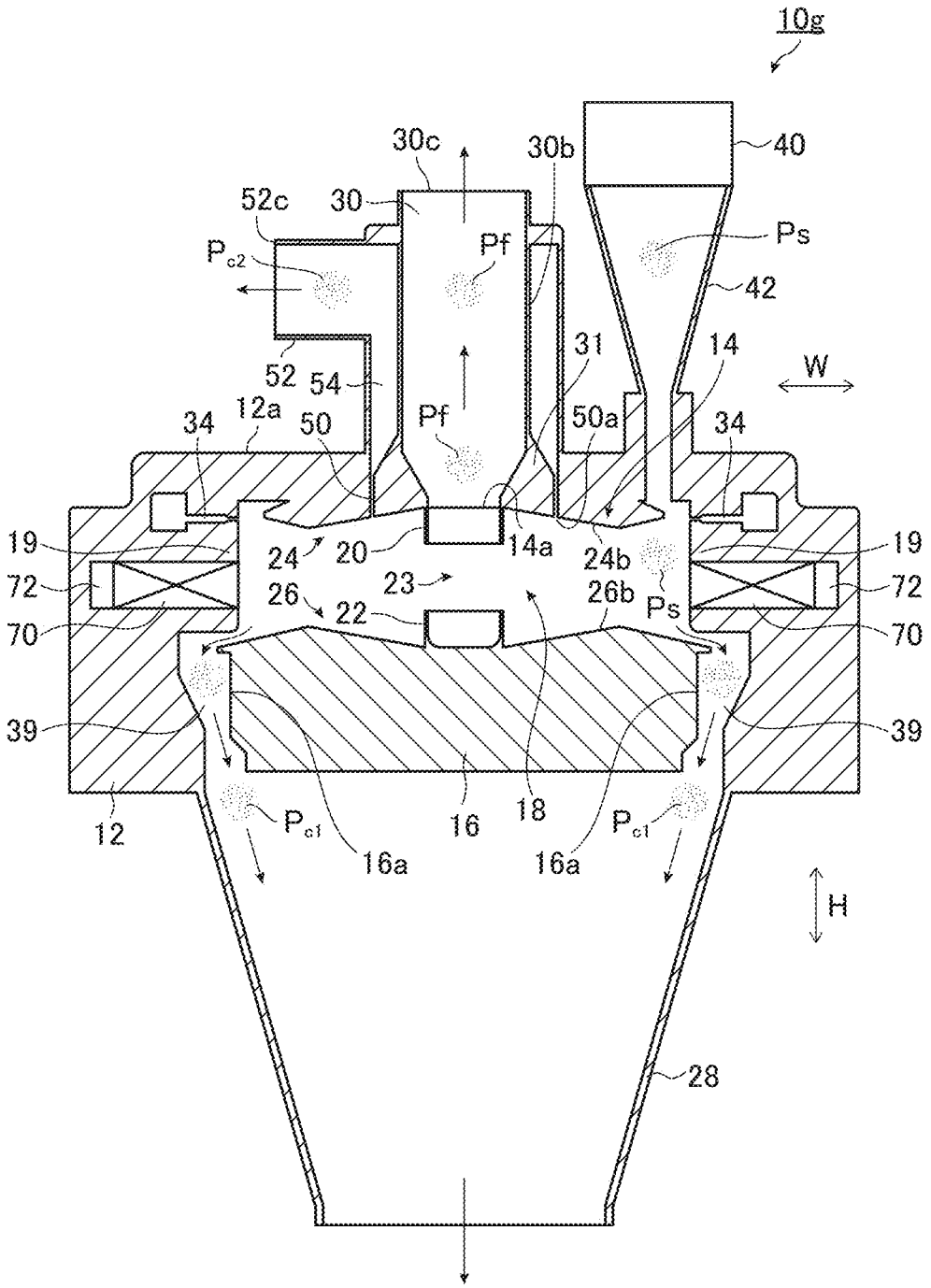
FIG. 10 is a schematic cross-sectional view showing an eighth example of the powder classifying apparatus in the embodiment of the invention.

FIG. 10 is a schematic cross-sectional view showing the eighth example of the powder classifying apparatus in the embodiment of the invention.

For a powder classifying apparatus 10*g* shown in FIG. 10, constituent elements identical to those of the powder classifying apparatus 10*a* shown in FIG. 3 are assigned the same reference signs and will not be described in detail.

The powder classifying apparatus 10*g* shown in FIG. 10 is different from the powder classifying apparatus 10*a* shown in FIG. 3 in that guide vanes 70 are disposed in place of the second air nozzles 38, and otherwise has the same configuration as the powder classifying apparatus 10*a* shown in FIG. 3.

In the powder classifying apparatus 10*g* shown in FIG. 10, a plurality of guide vanes 70 are disposed along the outer edge of the centrifugal chamber 18, as with the second air nozzles 38 in the powder classifying apparatus 10*a* shown in FIG. 3. The guide vanes 70 are disposed in the annular portion 19 under the first air nozzles 34 in the H direction. As with the first air nozzles 34, the guide vanes 70 are arranged at regular intervals in the circumferential direction of the centrifugal chamber 18 at a predetermined angle to a tangential direction of the outer edge of the centrifugal chamber 18.

A push-in chamber 72 used to store air and supply gas into the centrifugal chamber 18 is disposed at the outer peripheral portion of the guide vanes 70. The push-in chamber 72 is connected to a compressed gas supply section (not shown). Gas under a predetermined pressure, i.e., compressed gas is supplied from the compressed gas supply section and introduced from between the guide vanes 70 via the push-in chamber 72. Compressed gas is supplied separately to the first air nozzles 34 and the guide vanes 70, so that whirling streams are generated in the centrifugal chamber 18.

In the powder classifying apparatus 10*g*, the raw material powder Ps is centrifuged while it falls as whirling in the centrifugal chamber 18, and the guide vanes 70 act to regulate the whirling speed of the raw material powder Ps during the centrifugation. Each guide vane 70 is, for instance, pivotally supported by a pivot shaft (not shown) in the annular portion 19 and locked to a pivotal plate (not shown) by means of a pin (not shown). For example, when the pivotal plate is rotated, all the guide vanes 70 are thereby simultaneously rotated by a predetermined angle. By rotating the pivotal plate to rotate all the guide vanes 70 by a predetermined angle, the intervals between the guide vanes 70 can be adjusted to change the flow rate of gas, e.g., air passing through the guide vanes 70. Thus, the classification performance such as a classification point can be changed. Further, the provision of the guide vanes 70 expands a range of choices of the classification point. The powder classifying apparatus 10*g* shown in FIG. 10 also can provide the same effects as those obtained with the powder classifying apparatus 10*a* shown in FIG. 3.

While the guide vanes 70 are disposed in place of the second air nozzles 38 of the powder classifying apparatus 10*a* shown in FIG. 3, this modification is applicable to other examples. The guide vanes 70 may be disposed in place of the second air nozzles 38 in any of the powder classifying apparatus 10 shown in FIG. 1 and the powder classifying apparatuses 10*b* to 10*f* shown in FIGS. 4 to 9.

While the centrifugal chamber 18 has the inclined portion 24*b* and the inclined portion 26*b* in the third to eighth examples of the powder classifying apparatuses 10*c* to 10*g* shown in FIGS. 5 to 10, these examples are not limited to this configuration. In any of the third to eighth examples of the powder classifying apparatuses 10*c* to 10*g* shown in FIGS. 5 to 10, the surface portion 24 may be constituted of a flat surface parallel to the direction W, and the surface portion 26 may be constituted of a flat surface parallel to the direction W, as in the powder classifying apparatus 10 shown in FIG. 1. Alternatively, each of the powder classifying apparatuses may be configured to have the surface portion 24 constituted of a flat surface parallel to the direction W and the surface portion 26 provided with the inclined portion 26*b* or have the surface portion 24 provided with the inclined portion 24*b* and the surface portion 26 constituted of a flat surface parallel to the direction W.

The classification using the powder classifying apparatus of the invention is described below.

The applicant examined the classification using the powder classifying apparatus of the invention. Specifically, the classification was attempted on raw material powders using the foregoing powder classifying apparatus 10 shown in FIG. 1 and a comparative powder classifying apparatus 100 shown in FIG. 11

Figure 11:
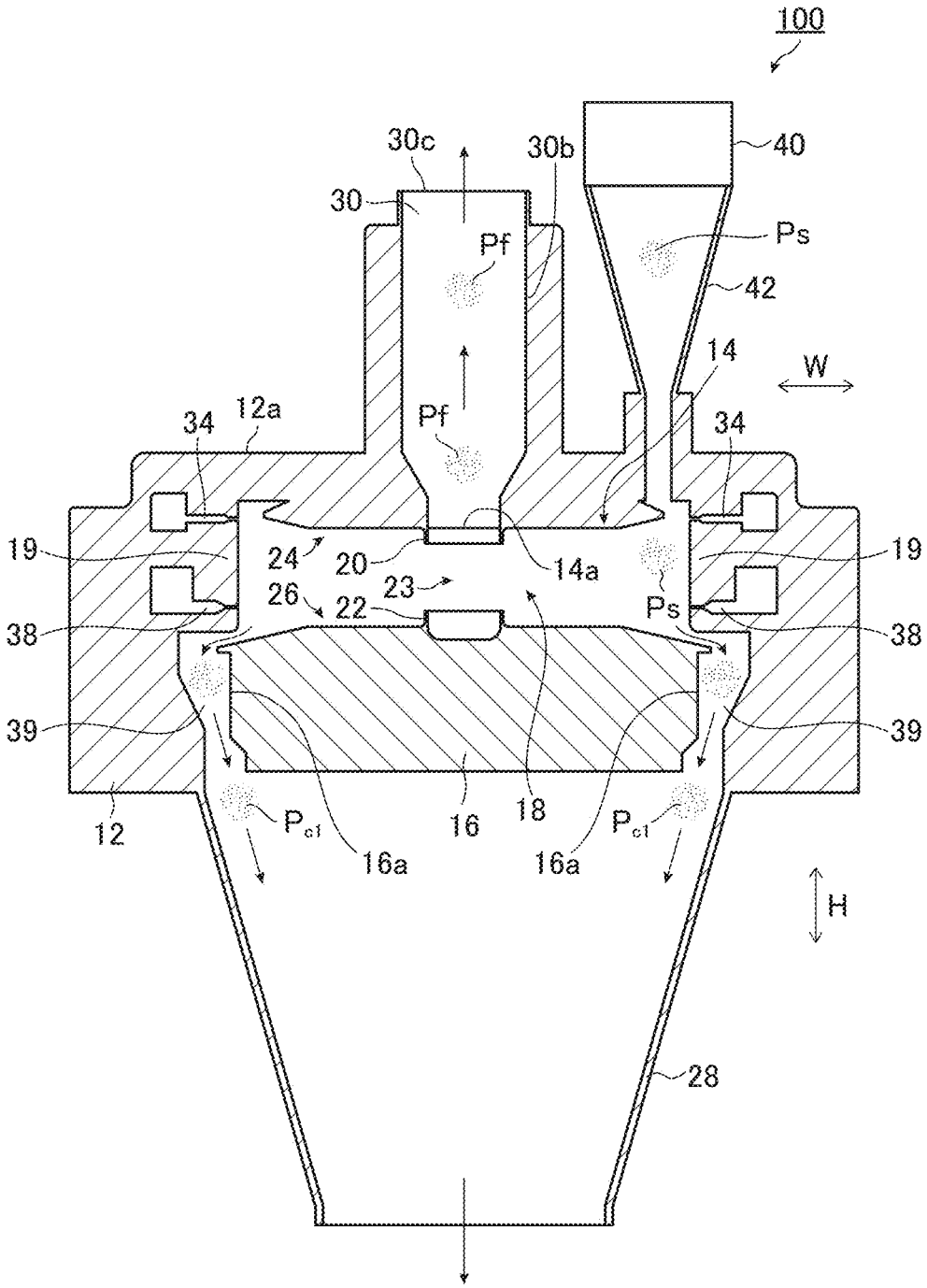
FIG. 11 is a schematic cross-sectional view showing a comparative powder classifying apparatus.

FIG. 11 is a schematic cross-sectional view showing the comparative powder classifying apparatus. For the powder classifying apparatus 100 shown in FIG. 11, constituent elements identical to those of the powder classifying apparatus 10 shown in FIG. 1 are assigned the same reference signs and will not be described in detail.

The powder classifying apparatus 100 shown in FIG. 11 is different from the powder classifying apparatus 10 shown in FIG. 1 in that the annular slit 50 is absent, and otherwise has the same configuration as the powder classifying apparatus 10 shown in FIG. 1. The numbers of the first air nozzles 34 and the second air nozzles 38 are each six.

The classification was carried out under classification conditions such as air volume being the same between the powder classifying apparatus 10 of the invention and the comparative powder classifying apparatus 100.

Silver particles and silicon particles were used as raw material powders. The results of the classification are shown in Table 1 below along with the average particle sizes of the raw material powders. The particle sizes presented below are all BET diameters determined by the BET method.

The raw material powder of silver particles, the raw material powder of silicon particles, particles after classification in the present invention, and particles after classification in the comparative case are separately shown in FIGS. 12A to 12C and FIGS. 13A to 13C.

Figure 12A:
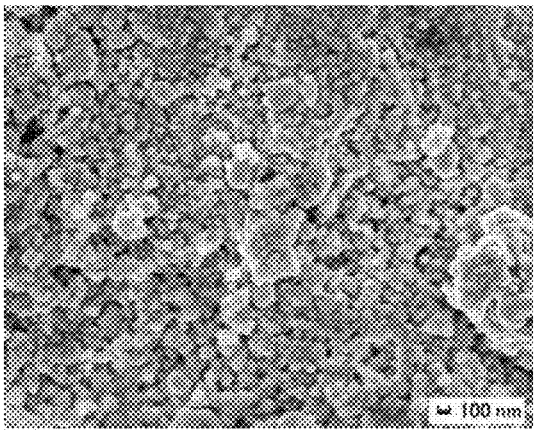
FIG. 12A is a schematic view showing an SEM image of raw material particles of silver particles before classification.
Figure 12B:
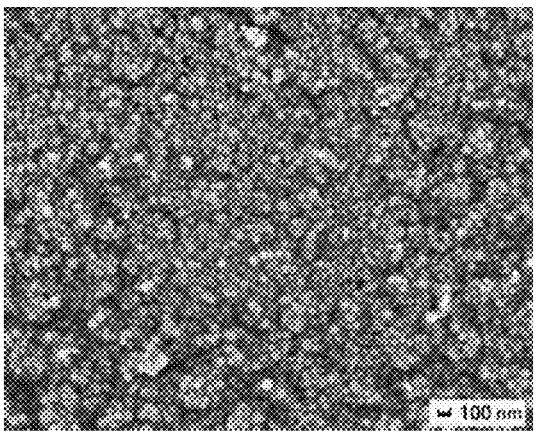
FIG. 12B is a schematic view showing an SEM image of silver particles after classification by means of the powder classifying apparatus of the invention.
Figure 12C:
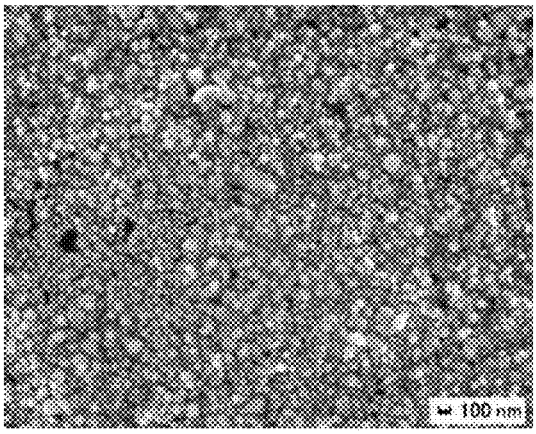
FIG. 12C is a schematic view showing an SEM image of silver particles after classification by means of the comparative powder classifying apparatus.

FIG. 12A is a schematic view showing an SEM image of the raw material particles of silver particles before classification; FIG. 12B is a schematic view showing an SEM image of silver particles after classification by means of the powder classifying apparatus of the invention; and FIG. 12C is a schematic view showing an SEM image of silver particles after classification by means of the comparative powder classifying apparatus.

Figure 13A:
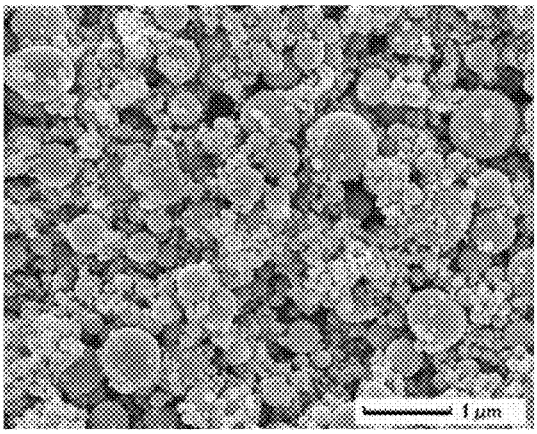
FIG. 13A is a schematic view showing an SEM image of raw material particles of silicon particles before classification.
Figure 13B:
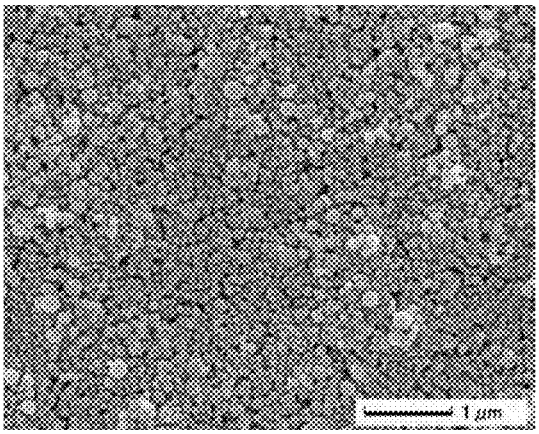
FIG. 13B is a schematic view showing an SEM image of silicon particles after classification by means of the powder classifying apparatus of the invention.
Figure 13C:
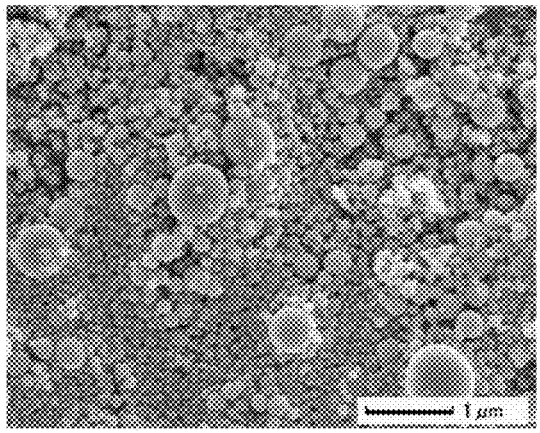
FIG. 13C is a schematic view showing an SEM image of silicon particles after classification by means of the comparative powder classifying apparatus.

FIG. 13A is a schematic view showing an SEM image of the raw material particles of silicon particles before classification; FIG. 13B is a schematic view showing an SEM image of silicon particles after classification by means of the powder classifying apparatus of the invention; and FIG. 13C is a schematic view showing an SEM image of silicon particles after classification by means of the comparative powder classifying apparatus.

TABLE 1

| Type of particles | Average particle size of raw material powder (BET diameter) | Particle size after classification in the present invention (BET diameter) | Particle size after classification in the comparative case (BET diameter) |
|---|---|---|---|
| Silver particles | 109 nm | 45 nm | 70 nm |
| Silicon particles | 92 nm | 75 nm | 85 nm |

In the case of silver particles, the particle size of fine powder obtained through the classification is smaller in the present invention as can be seen in Table 1 and FIGS. 12B and 12C. In the case of silicon particles, the particle size of fine powder obtained through the classification is smaller in the present invention as can be seen in Table 1 and FIGS. 13B and 13C. Thus, the present invention makes it possible to further lower the classification point regardless of the type of particles.

The present invention is basically configured as above. While the powder classifying apparatus of the invention is described above in detail, the invention is by no means limited to the foregoing embodiment and it should be understood that various improvements and modifications are possible without departing from the scope and spirit of the invention.

REFERENCE SIGNS LIST

10, 10*a*, 10*b*, 10*c*, 10*d*, 10*e*, 10*f*, 10*g* powder classifying apparatus
12 casing
14 upper disc-shaped portion
14*a* opening portion
14*b* opening plane
16 lower disc-shaped portion
18 centrifugal chamber
20 first wall portion
22 second wall portion
23 gap
28 coarse powder collecting chamber
30 fine powder collecting pipe
30*a* end portion
34 first air nozzle
38 second air nozzle
40 raw material supply section
50, 62 slit
50*a*, 62*a* suction port
52 pipe
66 collecting chamber
68 discharge pipe
70 guide vane
72 push-in chamber
100 powder classifying apparatus
Dc outer diameter of first wall portion
Dr inner diameter of slit
H direction
$P_{c1}$ coarse powder
Pf fine powder
$P_{c2}$ coarse powder
Ps raw material powder
W direction

The invention claimed is:

1. A powder classifying apparatus classifying raw material powder having a particle size distribution into fine powder and coarse powder, the apparatus comprising:

a centrifugal chamber of disc shape constituted of a space formed between two opposed members;

a gas supply device configured to supply gas into the centrifugal chamber to generate a whirling stream;

a raw material supply device configured to supply the raw material powder to the whirling stream generated in the centrifugal chamber;

a fine powder collecting pipe that is disposed in a central portion of one member of the two opposed members forming the centrifugal chamber, communicates with the centrifugal chamber, and has an opening portion used to discharge gas containing the fine powder separated through classification in the centrifugal chamber to an outside of the centrifugal chamber;

a coarse powder collecting chamber that is disposed at an outer edge portion of the centrifugal chamber on a side of the other member of the two opposed members, communicates with the centrifugal chamber, and is configured to discharge the coarse powder separated through classification in the centrifugal chamber to the outside of the centrifugal chamber, the other member being opposed to the one member provided with the fine powder collecting pipe across the centrifugal chamber;

an annular slit that is provided in at least one of the two opposed members forming the centrifugal chamber in a region between the central portion of the centrifugal chamber and the outer edge portion of the centrifugal chamber, communicates with the centrifugal chamber, and is configured to discharge gas in the centrifugal chamber to the outside of the centrifugal chamber;

a first wall portion of cylindrical shape disposed at the opening portion of the centrifugal chamber to project in the centrifugal chamber, the opening portion being formed from a fine powder collecting pipe; and a second wall portion of cylindrical shape disposed at the other member of the two opposed members forming the centrifugal chamber to face the first wall portion at a predetermined distance, wherein the annular slit has an inner diameter larger than an outer diameter of the opening portion, and wherein the annular slit is provided in each of the two opposed members forming the centrifugal chamber, and the annular slit provided in one of the two opposed members that has the opening portion is arranged concentrically with the opening portion.

2. The powder classifying apparatus according to claim 1, wherein the annular slit has a bending flow path.

3. The powder classifying apparatus according to claim 1, wherein the annular slit has a flow path larger in width than a suction port.

4. The powder classifying apparatus according to claim 1, wherein a suction volume of the annular slit is smaller than a suction volume of the fine powder collecting pipe.

5. The powder classifying apparatus according to claim 1, wherein the coarse powder collecting chamber is composed of a plurality of first air nozzles and a plurality of second air nozzles or a plurality of guide vanes, the plurality of second air nozzles or the plurality of guide vanes being disposed on a side of the other member with respect to the plurality of first air nozzles, and wherein the centrifugal chamber communicates with a coarse powder collecting chamber through a gap that is situated at the outer edge portion of the centrifugal chamber on a side of the other member with respect to the plurality of second air nozzles or the plurality of guide vanes, the coarse powder collecting chamber being provided to discharge the coarse powder to the outside of the centrifugal chamber.

6. A powder classifying apparatus classifying raw material powder having a particle size distribution into fine powder and coarse powder, the apparatus comprising:

a centrifugal chamber of disc shape constituted of a space formed between two opposed members;

a gas supply device configured to supply gas into the centrifugal chamber to generate a whirling stream;

a raw material supply device configured to supply the raw material powder to the whirling stream generated in the centrifugal chamber;

a fine powder collecting pipe that is disposed in a central portion of one member of the two opposed members forming the centrifugal chamber, communicates with the centrifugal chamber, and has an opening portion used to discharge gas containing the fine powder separated through classification in the centrifugal chamber to an outside of the centrifugal chamber;

a coarse powder collecting chamber that is disposed at an outer edge portion of the centrifugal chamber on a side of the other member of the two opposed members, communicates with the centrifugal chamber, and is configured to discharge the coarse powder separated through classification in the centrifugal chamber to the outside of the centrifugal chamber, the other member being opposed to the one member provided with the fine powder collecting pipe across the centrifugal chamber;

an annular slit that is provided in at least one of the two opposed members forming the centrifugal chamber in a region between the central portion of the centrifugal chamber and the outer edge portion of the centrifugal chamber, communicates with the centrifugal chamber, and is configured to discharge gas in the centrifugal chamber to the outside of the centrifugal chamber;

a first wall portion of cylindrical shape disposed at the opening portion of the centrifugal chamber to project in the centrifugal chamber, the opening portion being formed from a fine powder collecting pipe; and a second wall portion of cylindrical shape disposed at the other member of the two opposed members forming the centrifugal chamber to face the first wall portion at a predetermined distance, wherein the annular slit has an inner diameter larger than an outer diameter of the opening portion, and wherein the annular slit has a flow path larger in width than a suction port.

7. The powder classifying apparatus according to claim 6, wherein the annular slit is provided in, of the two opposed members forming the centrifugal chamber, a member having the opening portion, and the opening portion and the annular slit are concentrically arranged.

8. The powder classifying apparatus according to claim 7, wherein a suction port of the annular slit faces one of the two opposed members that has the annular slit, or a suction plane of the suction port of the annular slit is perpendicular to an opening plane of the opening portion.

9. The powder classifying apparatus according to claim 7, wherein the annular slit has a bending flow path.

10. The powder classifying apparatus according to claim 7, wherein a suction volume of the annular slit is smaller than a suction volume of the fine powder collecting pipe.

11. The powder classifying apparatus according to claim 7, wherein the coarse powder collecting chamber is composed of a plurality of first air nozzles and a plurality of second air nozzles or a plurality of guide vanes, the plurality of second air nozzles or the plurality of guide vanes being disposed on a side of the other member with respect to the plurality of first air nozzles, and wherein the centrifugal chamber communicates with a coarse powder collecting chamber through a gap that is situated at the outer edge portion of the centrifugal chamber on a side of the other member with respect to the plurality of second air nozzles or the plurality of guide vanes, the coarse powder collecting chamber being provided to discharge the coarse powder to the outside of the centrifugal chamber.

12. The powder classifying apparatus according to claim 6, wherein the annular slit is provided in each of the two opposed members forming the centrifugal chamber, and the annular slit provided in one of the two opposed members that has the opening portion is arranged concentrically with the opening portion.

13. The powder classifying apparatus according to claim 6, wherein the annular slit has a bending flow path.

14. The powder classifying apparatus according to claim 6, wherein a suction volume of the annular slit is smaller than a suction volume of the fine powder collecting pipe.

15. The powder classifying apparatus according to claim 6, wherein the coarse powder collecting chamber is composed of a plurality of first air nozzles and a plurality of second air nozzles or a plurality of guide vanes, the plurality of second air nozzles or the plurality of guide vanes being disposed on a side of the other member with respect to the plurality of first air nozzles, and wherein the centrifugal chamber communicates with a coarse powder collecting chamber through a gap that is situated at the outer edge portion of the centrifugal chamber on a side of the other member with respect to the plurality of second air nozzles or the plurality of guide vanes, the coarse powder collecting chamber being provided to discharge the coarse powder to the outside of the centrifugal chamber.

* * * * *